United States Patent [19]

Van Benthuysen et al.

[11] 3,988,711

[45] Oct. 26, 1976

[54] TANDEM ELECTRICAL CONTROL

[75] Inventors: John D. Van Benthuysen, Elkhart, Ind.; Thomas W. Flanders, Edwardsburg, Mich.

[73] Assignee: CTS Corporation, Elkhart, Ind.

[22] Filed: June 27, 1974

[21] Appl. No.: 483,624

[52] U.S. Cl. ..... 338/134; 64/2 R; 338/132; 338/174

[51] Int. Cl.[2] ..... H01C 10/16

[58] Field of Search ..... 338/123, 125, 128, 129, 338/130, 131, 132, 133, 134, 162, 163, 164, 166, 174, 150; 64/1 R, 2 R, 4; 308/163

[56] References Cited

UNITED STATES PATENTS

| | | | |
|---|---|---|---|
| 1,578,988 | 3/1926 | Hardy | 338/134 |
| 2,717,944 | 9/1955 | Daily et al. | 338/166 |
| 2,781,436 | 2/1957 | Barden | 338/134 |
| 2,789,191 | 4/1957 | Arisman et al. | 338/164 |
| 2,866,055 | 12/1958 | Arisman et al. | 338/134 |
| 2,894,237 | 7/1957 | Haynman | 338/150 |
| 2,968,779 | 1/1961 | Goode et al. | 338/166 |
| 3,256,713 | 6/1966 | Luefling et al. | 64/1 R |
| 3,373,393 | 3/1968 | Hauenstine et al. | 338/134 |
| 3,599,140 | 8/1971 | Ichikawa et al. | 338/128 |
| 3,611,245 | 10/1971 | Puerner | 338/134 |
| 3,769,813 | 11/1973 | Okada | 64/2 R |

FOREIGN PATENTS OR APPLICATIONS

| | | | |
|---|---|---|---|
| 522,063 | 2/1956 | Canada | 338/134 |

*Primary Examiner*—Volodymyr Y. Mayewsky

[57] ABSTRACT

A control comprises two variable resistance controls connected in tandem to a concentric shaft arrangement, an inner shaft of the concentric shaft arrangement containing an energy absorber, the inner shaft and the energy absorber providing an energy absorbing means for the control. The inner shaft made of glass-filled thermo-plastic further provides sufficient resiliency to prevent permanent shaft deformation and related knob wobble upon subjection of the shaft to severe impact and the energy absorber gradually absorbing the energy of impact minimizes axial movement of the inner shaft by eliminating the additional normally required tolerance. Additionally, the percentages of the glass and plastic mixture employed in making the shaft control torsional deflection.

7 Claims, 4 Drawing Figures

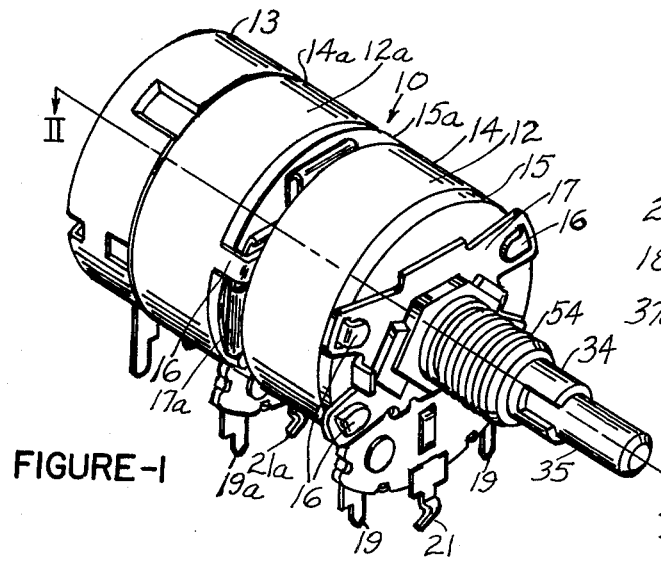
FIGURE-1
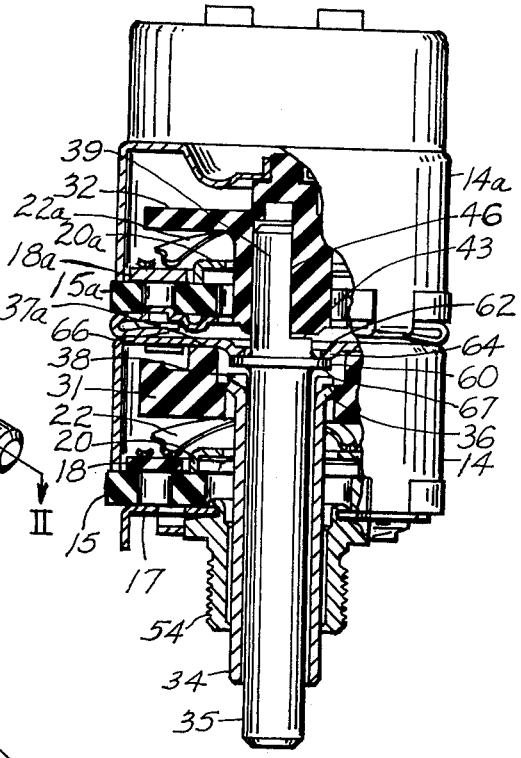
FIGURE-2
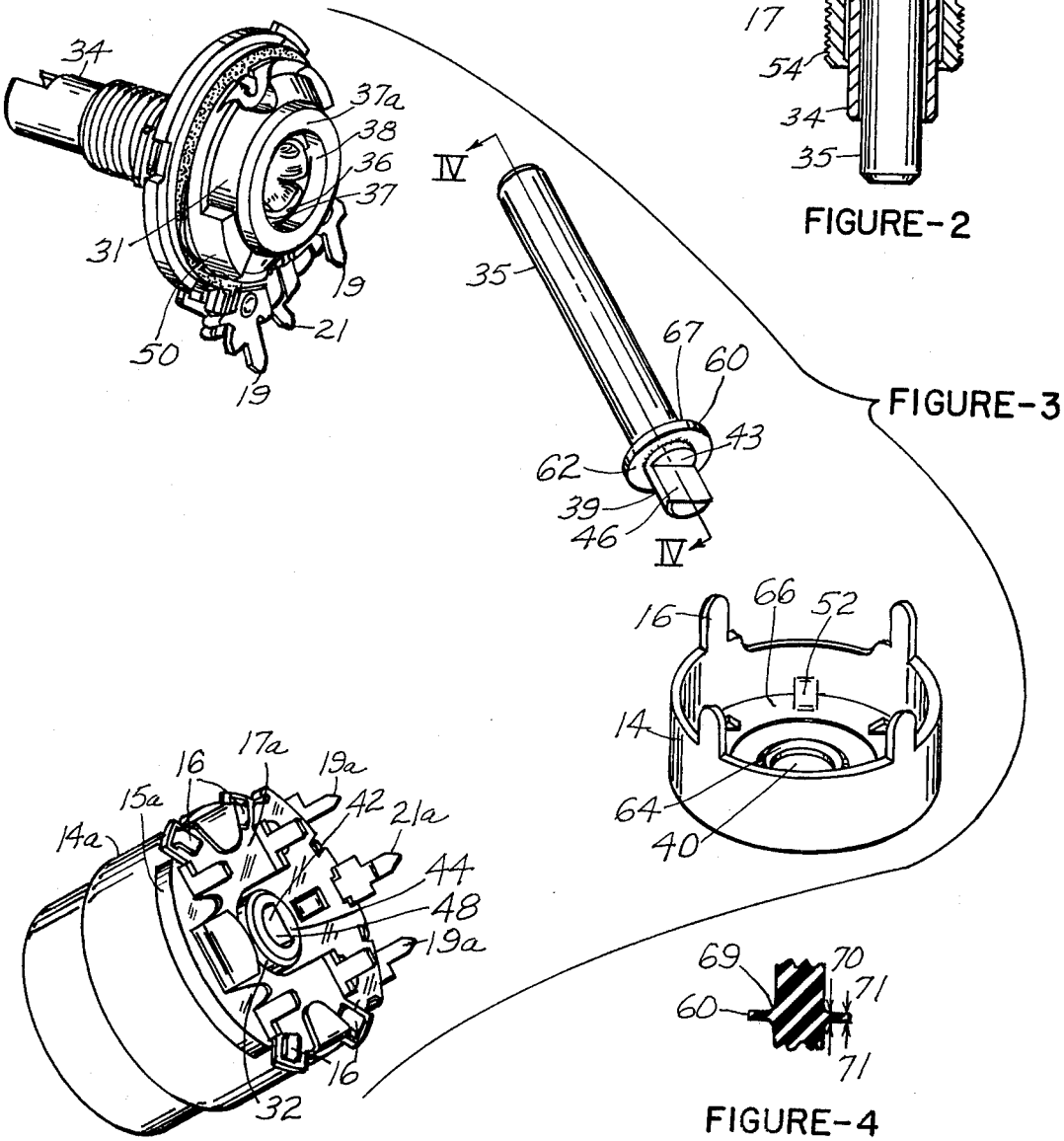
FIGURE-3
FIGURE-4

TANDEM ELECTRICAL CONTROL

The present invention relates to electrical controls and, more particularly, to a tandem variable resistance control having two variable resistors adjusted with two concentric shafts, each of the shafts controlling one of the variable resistors and to a glass-filled thermo-plastic shaft.

Many variable resistance control applications require two tandem variable resistors independently operated by concentric shafts, the shafts comprising an inner shaft and an outer shaft defined by a sleeve surrounding the inner shaft. The outer shaft operates the front variable resistance control and the inner shaft extending inwardly through the front variable resistance control operates the rear variable resistance control. The inner shaft also extends outwardly toward the operator beyond the outer shaft to permit attachment of a knob.

One of the problems of prior art tandem variable resistance controls is that the inner shaft has a high length to diameter ratio, and thus is more susceptible to impact during assembly of the control in a chassis and during operation. Additionally, as disclosed in U.S. Pat. No. 2,628,298, the inner shaft is generally circumferentially notched for receiving a C washer, the C washer abutting a surface of the control housing to minimize axial movement of the inner shaft. This notch further weakens the shaft for resisting impact. Therefore, the inner shaft usually has been made from a metal such as brass to provide the required strength even though a metal shaft can be a shock hazard. However, not only is the inner shaft susceptible to breaking at the notch, but impacts to the shaft can also cause permanent bending of the shaft. This bending of the shaft can cause an objectionable knob wobble during actuation of the control, or can even cause binding of the shaft during rotation of the control. Brass, unfortunately, does not always adequately resist bending; therefore, in some variable resistance control applications, the trend has been to replace brass with steel. Steel shafts even though providing good mechanical strength and rigidity are more readily susceptible to rust and corrosion.

The use of plastic shafts in electrical controls is well known. A plastic shaft in an electrical control is disclosed in U.S. Pat. No. 3,382,473, assigned to the same assignee as the present invention. Such shafts are of a relatively large diameter and short length and mechanical strength and rigidity and resistance to bending are not a critical factor in the controls in which such shafts are used. On the other hand, in tandem electrical controls, mechanical strength and rigidity and resistance to bending are necessary requirements for suitable inner shafts. Consequently, plastic shafts have been considered unsatisfactory for use as inner shafts because such shafts requiring a high length to diameter ratio do not possess the required mechanical strength and resistance to impact and bending. Furthermore, prevention of end play of the inner shaft is generally overcome by providing an annular groove in the shaft for receiving a C washer which abuts a portion of the housing. Providing such a groove in the shaft further weakens the shaft to resist impact and breaking. Therefore, it would be desirable to provide a relatively inexpensive inner plastic shaft that would still possess the necessary mechanical strength and rigidity and would also withstand severe bending forces.

Moreover, when dealing with prior art devices provided with a plastic shaft having a high length to diameter ratio, it is difficult to control the degree of torsional deflection or twist of the shaft. Torsional deflection is defined as the degree of rotation or turning of one end of a shaft through a certain angle before rotation occurs to the other end of the shaft. In some electrical controls, it is required to control the torsional deflection, for example, in cam actuated switches it is desirable to provide control over torsional deflection of the shaft so as to produce a smoother feel to the operation of the switch. It has been discovered that by adding a material such as glass fibers to the thermo-plastic material employed in making the shaft, control over torsional deflection is easily achieved by altering the percentages of the glass fibers and plastic mixture. It would, therefore, be desirable to provide a glass-filled thermo-plastic shaft for controlling torsional deflection.

Another problem in prior art devices of this type caused by impacts to the shaft is the potential damage to the control itself rather than merely damage to the shaft. Electrical controls such as tandem variable resistance controls are often mounted on panels, a portion of the control, for example, the ground plate, being securely attached to the panel. Impacts to the shaft are transmitted from the shaft through the shaft washer to the housing of the control unit to the ground plate often causing the housing of the control to pull apart from the ground plate. Prior art control devices such as the device shown in U.S. Pat. No. 3,611,245 compensate for impacts on the inner shaft by means of a thin spring washer to absorb the impact loads. However, this device depends primarily on the thin washer to absorb impacts. Furthermore, the spring washer is a separate element connected between a cover means and a collar. Therefore, the assembly of this particular control requires the additional steps of providing the spring washer and securing the washer to the control. It would therefore be desirable to provide a control wherein the inner shaft itself provides for impact absorption and wherein an additional impact absorption means is integrally molded with the shaft, thus providing additional impact resistance yet eliminating assembly steps in the manufacture of the control.

Another problem in prior art controls is the end play or axial movement of the inner shaft. In many conventional controls, the inner shaft contains a groove for receiving a C washer, the C washer abutting a surface of the control to halt axial movement of the shaft. The tolerance necessary to permit the C washer to engage the groove permits inward and outward axial movement of the shaft before the washer engages a bearing surface of the groove. This tolerance contributes to the end play of the inner shaft before the C washer firmly abuts a surface of the control to halt the axial movement. It would therefore be desirable to provide a control wherein the C washer is integral with the inner shaft eliminating the tolerance required to secure a separate C washer to the inner shaft.

Accordingly, an object of the present invention is to provide a new and improved tandem variable resistance control with concentric shafts. Another object of the present invention is to provide a tandem variable resistance control having an inner shaft with a washer integral therewith and functioning as an energy absorber. A further object of the present invention is to provide a more rigid inner shaft by adding glass fibers to the thermo-plastic material. Still another object of the present invention is to provide a shaft with an energy absober that minimizes the shaft end play. A still further object of the present invention is to provide a glass-filled thermo-plastic shaft having a certain percentage of glass so as to control torsional deflection.

Further objects and advantages of the present invention will become apparent as the following description proceeds and features of novelty characterizing the invention will be pointed out with particularity in the claims annexed to and forming a part of this specification.

Briely, the present invention is concerned with a tandem variable resistance control comprising front and rear variable resistors, and concentric shafts consisting of an outer hollow shaft connected to the front variable resistor and a solid inner shaft disposed concentrically within the outer shaft and extending through the first variable resistor to the second variable resistor. The inner shaft contains an energy absorber defined by an integral washer, the washer abutting a portion of the housing of the first variable resistor. Each of the front and rear variable resistors comprises a base supporting a resistive element and a driver containing a contactor constrained to rotate with the driver for engaging the resistive elements. The inner shaft with the integral washer provides energy absorbing means and the shaft being made of glass fibers and thermo-plastic material is sufficiently rigid to resist breakage and failure and yet sufficiently resilient to resist permanent bending. The integral washer also minimizes end play or axial movement of the inner shaft.

For better understanding of the present invention, reference may be had to the accompanying drawings wherein the same reference numerals have been applied to like parts and wherein:

FIG. 1 is an isometric view of a tandem variable resistance control built in accordance with the present invention;

FIG. 2 is a sectional view of a portion of the control taken along line II—II of FIG. 1;

FIG. 3 is an exploded view of the control shown in FIG. 1; and arcuate resistance paths 18 and 18*a*, e.g., a carbon film resistance element, are suitably bonded or mechanically secured to the inner surface of the bases 15 and 15*a* and the ends of the resistance elements are connected to terminals 19 and 19*a*. When a not-shown wirewound resistance element is employed instead of a carbon film resistance element, it is insulatedly disposed in the housings 14 and 14*a* in a manner well known in the art. Collector rings 20 and 20*a* mounted on the bases 15 and 15*a* in spaced relationship to the resistance paths 18 and 18*a* are provided with center terminals 21 and 21*a* and contactors 22 and 22*a* electrically connect the resistance paths 18 and 18*a* to the collectors 20 and 20*a*.

A pair of contactor drivers, a front driver 31 and a rear driver 32, are constrained to move with a control actuating means consisting of an outer hollow shaft 34 and an inner shaft 35, the outer shaft 34 being secured to the front driver 31 and the inner shaft 35 interfitting the rear driver 32, the inner shaft 35 being e.g., a molded thermo-plastic such as nylon containing glass fibers in an amount which is in the range between 1–70 percent so as to control the torsional deflection. In the range of 1–10 percent of glass fibers in the shaft, there is exhibited a high torsional deflection. In the range of 11–25 percent of glass fibers in the shaft, there is exhibited a controlled torsional deflection wherein a smoother feel in the operation of the switch of the electrical control is obtained. In the range of 26–40 percent of glass fibers in the shaft, there is exhibited a lower torsional deflection and in the range of 41–70 percent of glass fibers in the shaft, there is minimum torsional deflection. Currently in a particular embodiment of the present invention, the amount of glass fibers used in the making of the inner shaft is approximately 33 percent. A table given below shows the comparable results of the angles of deflection obtained by applying 1–15 inch-pounds of torque to a shaft of one inch in length with a 0.187 diameter made of 0 percent glass fibers and 33 percent glass fibers. Since the angle of deflection is proportional to length, a 2 inch shaft would have twice the indicated deflection.

| Inch-Pounds of Torque | Angle of Deflection Zero Percent Glass Fiber | Angle of Deflection 33% Glass Fiber |
|---|---|---|
| 1 | 7° | 3° |
| 2 | 15° | 6° |
| 3 | 22° | 10° |
| 4 | 34° | 15° |
| 5 | 47° | 20° |

FIG. 4 is a fragmentary sectional view of the shaft taken along line IV—IV of FIG. 3.

With reference to the drawings, there is illustrated a combination tandem variable resistance and switch control indicated at 10 comprising a pair of variable resistors 12 and 12a with an electrical switch 13 secured to resistor 12a in a conventional manner. The switch 13 forms no part of the present invention and therefore will not be further described.

Each of the variable resistors 12 and 12*a* has a cup-shaped housing 14 and 14*a* having a base 15 and 15*a* respectively of suitable electrical nonconductive material closing the open end of the housing. The bases 15 and 15*a* are fixedly secured to the housings 14 and 14*a* respectively with a plurality of ears 16 folded over ground plates 17 and 17*a*. Resistance means defining The outer shaft 34 extends through the base 15 and its end portion 36 as best seen in FIGS. 2 and 3 is staked to the front driver 31, the end portion 36 of outer shaft 34 being secured to the bottom surface 37 of the recess 38 in the front driver 31. The recess 38 in driver 31 is further defined by a top surface 37a, the surface 37*a* abutting housing 14. The inner shaft 35 concentrically disposed within the outer hollow shaft 34 contains a portion 39 extending through the aperture 40 in the housing 14 and interfitting the center cavity 42 of the rear driver 32. The inner shaft bearing portion 43 abuts the rear driver bearing surface 44 and the inner shaft flat portion 46 mates with the cavity surface 48. The outer shaft 34 is rotatably mounted in the housing 14 concentric to the arcuate resistance path 18 and rotatably supports the front driver 31, the contactor 22 being secured to the front driver 31 and constrained to rotate therewith for wiping contact with the resistance path 18 and the collector ring 20. The contactor 22*a* is secured to the rear driver 32, and constrained to rotate therewith for wiping contact with the resistance path 18a and the collector 20*a*. Each of the variable resistance controls 12 and 12*a* employs conventional stop means to halt rotation of shafts 34 and 35. As seen in FIG. 3, front driver 31 contains projection 50 and housing 14 contains stop member 52, the stop member 52 engaging projection 50 to halt rotation of driver 31. Driver 32 and housing 14a contain similar stop means. The control 10 can be mounted to a not-shown mounting panel with the outer shaft 34 extending through an opening provided in the panel by securing a fastener such as a nut to a threaded bushing 54, fixedly secured to the ground plate 17.

A molded washer 60 also functioning as an energy absorber and extending around the shaft 35 is integrally molded with the inner shaft 35. The washer is defined by a first radially extending surface 62 disposed adjacent a bearing 64 of the housing 14, the bearing 64 forming a part of the circular end wall 66 of the housing 14, the washer 60 further being defined by a second radially extending surface 67 in spaced parallel relationship to the first surface 62 and disposed adjacent the end portion 36 of the outer hollow shaft 34. The distance between the first and second surfaces 62 and 67 determines the amount of force necessary to shear the washer from the shaft during impact. The maximum possible axial end play of the inner shaft 35 is the distance between the bearing 64 of housing 14 and the end portion 36 of shaft 35 less the thickness of the washer 60. Assuming the washer surface 67 is in a position abutting the end portion 36 of the outer shaft 34, and inward thrust or impact upon the inner shaft 35 causes the inner shaft to move forwardly to the point where the surface 62 of the washer abuts the bearing 64.

Impacts to the shaft 35 are absorbed in the shaft 35 and the molded washer 60 and any portion of the impact to the shaft 35 that is not absorbed by the washer and the shaft is transmitted from the washer to the circular end wall 66 of the housing 14 and from the housing 14 through the ears 16 to the ground plate 17. Further, to increase the shear strength between the washer 60 and the shaft 35 resulting from increased impacts, a circular fillet 69 is provided between the washer 60 and the shaft as seen in FIG. 4. The fillet 69 causes a slight increase in the thickness of the washer at the junction with the shaft and provides greater resistance to shearing. The thickness of the washer 60 at the junction 70 with the shaft is substantially greater than the thickness of the washer at the outer edge 71 of the washer. It is apparent in accord with the present invention that the energy absorption means comprises an inner shaft concentrically disposed within the outer hollow shaft and a washer 60 functioning as an energy absorber integral with the inner shaft.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed as new and desired to be secured by Letters Patent of the United States is:

1. A tandem electrical control comprising first and second cup-shaped housing sections, said first housing section containing an end wall and a circular side wall, each of said housing sections containing a base assembly having a dielectric base supporting a resistance element and a collector and a contactor assembly having a rotatable driver of dielectric material and an electrically conductive contactor secured to the driver and constrained to rotate therewith for wipingly engaging the resistance element and the collector, termination means for connecting the resistance element and the collector to an electrical circuit, said rotatable driver of said first housing section being provided with a bottom surface and containing a bearing surface adjacent said end wall of the first housing section and a recess extending from said bottom surface to said bearing surface, a tubular outer shaft engaging the contractor assembly contained in the first housing section and rotatable with the driver in the first housing section, the outer shaft being supported by the first housing section, and energy absorption means comprising an inner shaft concentrically disposed with said outer shaft and engaging the contactor assembly contained in said second housing section and rotatable with the driver in the second housing section, and an energy absorber integral with said inner shaft and containing a first surface and a second surface spaced apart from said first surface and substantially parallel thereto, said first surface being adjacent said end wall of said first housing section and the second surface being adjacent to the bottom surface of the driver, said inner shaft being made of molded thermo-plastic containing glass fibers, the amount of glass fibers in the glass-filled molded thermo-plastic of said inner shaft being in the range of 1–70 percent.

2. In a tandem electrical control, the combination of a first and a second housing section, a resistance element and a collector and a rotatable driver of dielectric material contained in each of said housing sections, a dielectric base supporting the collector and the resistance element, termination means for connecting the resistance element and the collector to an electrical circuit, an electrically conductive contactor constrained to rotate with each of said rotatable drivers for wipingly engaging the resistance element and the collector, an outer hollow shaft connected to the rotatable driver disposed in said first housing section and rotatable with the driver in the first housing section, the outer shaft being supported by the first housing section, and energy absorption means of thermo-plastic material engaging the rotatable driver disposed in said second housing section and comprising an inner shaft concentrically disposed within said outer hollow shaft and rotatable with the driver in the second housing section, and an energy absorber having a diameter greater than the diameter of the inner shaft and integral with said inner shaft and disposed adjacent to the first housing section, the thickness of said energy absorber being greater at the junction of the energy absorber and said inner shaft than at points on the energy absorber radially spaced from said inner shaft.

3. The tandem electrical control of claim 2, wherein said energy absorption means of thermo-plastic material is filled with glass fiber.

4. The tandem electrical control of claim 3, wherein said energy absorption means contains at least 11 percent of glass fibers.

5. The tandem electrical control of claim 2, wherein said inner shaft contains at least 11 percent glass fibers and said energy absorber forms an arcuate attachment with said inner shaft.

6. The tandem electrical control of claim 2, wherein said first housing section contains an end wall joined to said second housing section and the rotatable driver disposed in the first housing section has a recess defined by a top wall and a bottom wall, said energy absorber being disposed in said recess and containing a first surface adjacent said bottom wall and a second surface spaced apart from said first surface such that upon the inward axial thrust of said inner shaft, the maximum travel of said inner shaft is the distance between said second surface and the end wall of said housing.

7. A tandem electrical control comprising first and second cup-shaped housing sections, said first housing section containing an end wall and a circular side wall, each of said housing sections containing a base assembly having a dielectric base supporting a resistance element and a collector and a contactor assembly having a rotatable driver of dielectric material and an electrically conductive contactor secured to the driver and constrained to rotate therewith for wipingly engaging the resistance element and the collector, termination means for connecting the resistance element and the collector to an electrical circuit, said rotatable driver of said first housing section being provided with a bottom surface and containing a bearing surface adjacent said end wall of the first housing section and a recess extending from said bottom surface to said bearing surface, a tubular outer shaft engaging the contactor assembly contained in the first housing section and rotatable with the driver in the first housing section, and energy absorption means comprising an inner shaft concentrically disposed within said outer shaft and engaging the contactor assembly contained in said second housing section and rotatable with the driver in the second housing section, the outer shaft being supported by the first housing section, and energy absorber joined to said inner shaft and containing a first surface and a second surface spaced apart from said first surface and substantially parallel thereto, said first surface being adjacent said end wall of said first housing section, the inner shaft comprising 30–99 percent thermo-plastic material and 1–70 percent of glass fibers embedded in said thermo-plastic material.

* * * * *